US005509430A

United States Patent [19]

Berger

[11] Patent Number: 5,509,430

[45] Date of Patent: Apr. 23, 1996

[54] BICOMPONENT FIBERS AND TOBACCO SMOKE FILTERS FORMED THEREFROM

[75] Inventor: Richard M. Berger, Midlothian, Va.

[73] Assignee: American Filtrona Corporation, Richmond, Va.

[21] Appl. No.: 166,009

[22] Filed: Dec. 14, 1993

[51] Int. Cl.[6] ..... A24D 3/06

[52] U.S. Cl. ..... 131/341; 131/345; 156/167; 264/173.16; 425/131.5; 428/225; 428/227; 428/401

[58] Field of Search ..... 131/331, 332, 131/335, 341, 342, 343, 344; 428/174, 221–240, 296, 273, 401; 156/167; 264/171; 425/131.5

[56] References Cited

U.S. PATENT DOCUMENTS

| | | | |
|---|---|---|---|
| 2,688,380 | 9/1954 | MacHenry | 131/342 X |
| 3,347,247 | 10/1967 | Lloyd | 131/342 |
| 3,381,070 | 4/1968 | Sublett et al. | 131/342 X |
| 3,409,020 | 11/1968 | Westbrook et al. | 131/342 X |
| 3,744,497 | 7/1973 | Marciuliano | 131/342 |
| 4,307,151 | 12/1981 | Yamachi et al. . | |
| 5,074,320 | 12/1991 | Jones et al. | 131/344 X |
| 5,094,717 | 3/1992 | Manning et al. . | |
| 5,105,834 | 4/1992 | Saintsing et al. | 131/335 X |
| 5,246,772 | 9/1993 | Manning . | |
| 5,254,399 | 10/1993 | Oku et al. . | |
| 5,298,348 | 3/1994 | Kung . | |

*Primary Examiner*—Jennifer Bahr
*Attorney, Agent, or Firm*—Jacobson, Price, Holman & Stern

[57] ABSTRACT

Sheath-core bicomponent fibers comprising a core of a low-cost, high strength, thermoplastic material, preferably polypropylene, completely covered with a sheath formed preferably of plasticized cellulose acetate, ethylene-vinyl acetate copolymer, polyvinyl alcohol or ethylene-vinyl alcohol copolymer, are produced, preferably melt blown to an average diameter of 10 microns or less, and formed into tobacco smoke filters. The resultant filters retain the desirable taste properties and processing capabilities of conventional cellulose acetate filter elements, but are substantially less expensive. Because the core material is non-absorbent, less plasticizer or additive is required for comparable properties, and a web, roving or filter made of such materials has a longer shelf-life. The very fine fibers can be formed of various cross-sections, providing higher surface area and requiring less air in the melt blowing and manufacturing processes. With sheaths of polyvinyl alcohol or ethylene-vinyl alcohol copolymer, the filter element readily disintegrates when subjected to environmental conditions leaving behind only a multiplicity of very fine, substantially unnoticeable, fibers as residue.

45 Claims, 3 Drawing Sheets

EFFECT OF PLASTICIZER ON FLOW CHARACTERISTICS OF CELLULOSE ACETATE RESINS

BICOMPONENT FIBERS AND TOBACCO SMOKE FILTERS FORMED THEREFROM

The invention relates to unique polymeric bicomponent fibers and to the production of low cost tobacco smoke filters from bicomponent fibers comprising a core of a low cost, high strength, thermoplastic polymer, preferably polypropylene, and a bondable sheath of a material, preferably selected from plasticized cellulose acetate, ethylene-vinyl acetate copolymer, polyvinyl alcohol or ethylene-vinyl alcohol copolymer.

While bicomponent fibers comprising a sheath of each of these polymeric materials have unique properties and advantages particularly when used in tobacco smoke filters, they share several common attributes which are important to commercial application of the instant inventive concepts. Perhaps foremost to the smoking public, each of these sheath materials have been determined to have acceptable taste impact when used to filter tobacco smoke. Moreover, such bicomponent fibers may be melt blown to produce very fine fibers, on the order of about 10 microns or less in diameter, in order to obtain enhanced filtration. A further commercially important feature of these bicomponents fibers is that they can be produced continuously and converted simultaneously in a one step process into tobacco smoke filters. Thus, tobacco smoke filters formed from bicomponent fibers according to this invention can provide improved filtration efficiency and acceptable taste impact, at a substantially lower cost when used on cigarettes and other smoking articles.

BACKGROUND OF THE INVENTION

A wide variety of fibrous materials have been employed in tobacco smoke filter elements. However, the choice of materials for use in production of such filters has been limited because of the need to balance various commercial requirements. A very important property of a tobacco smoke filter is obviously its filtration efficiency, i.e., its ability to remove selected constituents from the tobacco smoke. However, the range of filtration efficiency has had to be compromised in order to satisfy other commercially important factors such as resistance to draw, hardness, impact on taste, and manufacturing costs.

Cellulose acetate has long been considered the material of choice in the production of tobacco smoke filters, primarily because of its ability to provide commercially acceptable filtration efficiency, on the order of about 50%, without significantly detracting from the tobacco taste, low resistance to draw, and filter hardness desired by the majority of smokers.

A significant component of the commercially desirable "taste" is provided by the standard plasticizers utilized in the production of filter elements from cellulose acetate fibers, usually triethylene glycol acetate or glycerol triacetate ("triacetin"). In conventional cigarette filter manufacturing, the plasticizer is commonly applied to the cellulose acetate fiber by spraying or wicking using art-recognized techniques. The tendency of the plasticizer to migrate toward the center of conventional cellulose acetate fibers reduces the level of plasticizer at the fiber surface, minimizing its taste-enhancing capability and limiting the shelf life of plasticized tow fibers before being processed into filter rods. The plasticizer is therefore usually added to the tow during the manufacture of the filter rods.

Cellulose acetate fiber plasticized in this manner and wrapped with paper into rod-like forms become bondable at the fiber contact points, enabling the formation of relative self-sustaining, elongated filter rods in two to four hours. This process can be accelerated by the application of gases at elevated temperatures simultaneously with the formation of the filter rod. Filter rods produced in this manner provide a tortuous path for the passage of tobacco smoke when discrete lengths of such material are utilized as tobacco smoke filter elements.

Filtration efficiency can be increased significantly through the use of small fibers which provide increased fiber surface area at the same weight of fiber. Solvent spun cellulose acetate fiber is commercially available only in fiber sizes down to 13 microns in diameter. To obtain finer cellulose acetate fiber, e.g., 10 microns or less, melt spinning of plasticized cellulose acetate resin would be required; however, the level of plasticizer necessary to directly spin such fine cellulose acetate fibers would render the resultant fibers very weak and commercially useless. Melt spun cellulose acetate of a larger diameter, which would require less plasticizer, would have to be drawn and crimped to produce such fine fibers for use in tobacco smoke filters. Unfortunately, melt spun cellulose acetate fibers can only be commercially drawn at relatively low draw ratios before the fibers break during processing. The inability to form and process very fine fibers of cellulose acetate places practical limits on the filtration efficiency capabilities of this material in the production of tobacco smoke filters.

Further, and very important commercially, by comparison with other polymeric materials such as the polyolefins, cellulose acetate is relatively expensive, costing, for example, on the order of more than three times as much as commercially available polypropylene in resin form. While attempts have been made to utilize other less expensive and more easily processed polymeric materials such as polypropylene in lieu of cellulose acetate in the manufacture of tobacco smoke filters, such efforts have been almost universally abandoned on a commercial level, primarily because of the undesirable impact of such materials on the taste properties of tobacco smoke. Also, such use is generally limited by the inability to easily bond the fibers in order to obtain the desired filter hardness at required resistance to draw.

Another problem with commercially available tobacco smoke filters, particularly cigarette filters, currently on the market is the difficulty in disposing of such materials after use. By bonding highly crimped cellulose acetate fibers at their contact points, conventional cigarette filters are designed to provide a significant volume of interstitial space for the passage of smoke. The bonded contact points of such filter elements degrade very slowly under normal environmental conditions resulting in high volume, long life, environmentally undesirable litter.

OBJECTS OF THE INVENTION

It is a primary object of this invention to provide unique polymeric bicomponent fiber materials which afford the advantages of cellulose acetate, particularly when used in the manufacture of tobacco smoke filters, while overcoming many of the aforementioned commercially recognized disadvantages of such material.

A further important object of the instant invention is to provide a tobacco smoke filter which affords the advantages of conventional cellulose acetate fiber filters at significantly lower cost.

Another object of this invention is to provide a sheath-core bicomponent fiber material, particularly for the use in the production of tobacco smoke filter elements, which combines the commercially desirable taste, hardness, and resistance to draw properties of cellulose acetate fiber filters with a low cost, high strength, polymeric material such as polypropylene.

A further object of the instant inventive concepts is to provide a tobacco smoke filter formed from sheath-core bicomponent fibers in which the sheath will rapidly degrade when subjected to environmental conditions, leaving only unbonded fine fibers which are of very low volume as compared to the filter element from which they came, and virtually unnoticeable.

A still further object of this invention is the provision of a bicomponent fiber which has been attenuated using melt blown fiber techniques resulting in very fine fibers having average diameters on the order of about 10 microns or less.

Yet another object of the instant invention is to provide very fine bicomponent fibers which can be used to form a tobacco smoke filter rod of high filtration efficiency while maintaining the structural integrity of the filter rod, thereby further reducing costs.

Still another object of the invention is to provide filter rods, filter elements, and filtered cigarettes and the like incorporating filter elements made from such melt blown, bicomponent fibers, which have commercially desirable taste properties, filtration efficiency, resistance to draw, and hardness properties, and methods of making such materials in a highly efficient and commercially acceptable manner.

Upon further study of the specification and the appended claims, additional objects and advantages of this invention will become apparent to those skilled in the art.

SUMMARY OF THE INVENTION

These and other objects of this invention are achieved by the provision of a bicomponent fiber which has preferably been melt blown, having a core of low cost, high strength polymeric material, preferably polypropylene, and a sheath of a bondable polymeric material preferably selected from plasticized cellulose acetate (CA), ethylene-vinyl acetate copolymer (EVA), polyvinyl alcohol (VAL), and ethylene-vinyl alcohol copolymer (EVAL), and the processing of such fibers to form relatively self-sustaining, elongated filter rods which may be subdivided to produce a multiplicity of filter elements for incorporation into filtered cigarettes or the like.

The term "bicomponent" as used herein refers to the use of two polymers of different chemical nature placed in discrete portions of a fiber structure. While other forms of bicomponent fibers are possible, the more common techniques produce either "side-by-side" or "sheath-core" relationships between the two polymers. The instant invention is concerned primarily with production of "sheath-core" bicomponent fibers where a bondable sheath polymer is spun to completely cover and encompass a core of relatively low cost, high strength polymeric material such as polypropylene, preferably using a "melt blown" fiber process to attenuate the fiber. With this construction, the core material may comprise at least about 50 weight %, and as much as about 90 weight % of the total fiber, providing high strength to the fiber at substantially less material cost than a fiber comprised entirely of cellulose acetate. With denser sheath materials, higher weight percentages of sheath material may be desirable, e.g., 40%, sheath/core, to insure proper coverage for successful bonding and taste impact while still maintaining a majority of core material. Even lesser amounts of core material in the conjugate reduces the cost of the fiber and tobacco smoke filters made therefrom in a commercially significant manner.

When used in the production of a tobacco smoke filter, the sheaths of juxtaposed fibers in a tow formed of CA, EVA, VAL or EVAL, can be bonded at their contact points to form self-sustaining filter rods by the techniques described herein to provide a filtration efficiency, hardness, and resistance to draw similar to conventional cellulose acetate filters. Also, since only the surface sheath contacts the smoke, the highly desirable taste properties of the sheath polymer are realized and the undesirable impact on taste properties of the core material is avoided.

While bicomponent fibers are well known, certain sheath-core conjugates according to this invention are believed to be unique, having attributes that would not have been expected. For example, because of the difficulty in melt spinning CA and providing compatibility and attenuation of a composite formed with a thermoplastic such as polypropylene, bicomponent fibers of such materials formed by melt blowing of the conjugate according to this invention, are believed novel. Likewise, while side-by-side bicomponent fibers of EVA and a polyolefin have been suggested, primarily for use as a binder, in the production of tobacco smoke filters comprised principally of cellulose acetate staple fibers, the advantages of using continuous EVA sheath-core fibers to provide the major component, or the entirety, of such filter products has not been recognized. Moreover, the ability of a bicomponent fiber having a high strength, low cost, core such as polypropylene, and a sheath of VAL or EVAL, to form relatively stable and self-sustaining air-permeable, bonded rods which will function effectively as smoke filters, and yet, readily disintegrate when subjected to environmental conditions, is unexpected.

Bicomponent fibers of this nature, produced by conventional "melt blown" fiber spinning techniques, can be attenuated during extrusion to produce ultrafine fibers. Although cellulose acetate fibers on the order of about 11 microns are known, as indicated above, the smallest currently available commercial cellulose acetate fibers are generally about 13 microns or more in diameter. With the instant inventive concepts, bicomponent fibers of 10 microns and less, down to 5 and even about 1 micron, can be produced and incorporated into a tobacco smoke filter rod.

The sheath of CA, EVA, VAL, or EVAL polymer not only provides a resultant tobacco smoke filter with the commercially desirable taste properties demanded by the smoking public, but a tow or web comprising such fibers has the excellent bonding properties expected of such materials, and such fibers can be processed on suitably adapted commercial high speed filter rod manufacturing equipment commonly in use in the industry. Moreover, when heat-accelerated bonding is used, the core of polypropylene in such bicomponent fibers retains its strength during the heat processing of the tow, minimizing flattening and providing high loft. Also, with a polypropylene (or the like) core, the tendency of fibers made entirely of cellulose acetate to collapse when subjected to hot, moist tobacco smoke ("hot collapse"), resulting in smoke bypass, is obviated.

Bicomponent fibers according to this invention may be formed with a cylindrical core and surrounding sheath, but such materials may also be extruded through a melt blown fiber die that produces a non-round cross-section. For example, known techniques and equipment can be used for the production of trilobal or "Y" shaped fibers. Likewise, fibers of an "X" or other multi-legged extended cross-section fiber shape may be produced. In all such fibers, the sheath polymer should still completely cover the polypropylene core to provide the advantages referred to previously. However, the non-round cross-section is particularly advantageous in providing increased surface area for filtration purposes in the ultimate product.

Further, the production of fibers having non-round cross-section and, thus, increased surface area, also improves the effectiveness of the air used to attenuate the fibers in the melt blowing process, producing a higher loft in the resultant web. This is an important factor in that, with a melt blown product, crimp is not produced. Non-round cross-sections generally result in a reduction in the quantity of air required in the processing of the bicomponent fibers which further reduces the manufacturing cost, not only by reducing the cost of providing the compressed air, but also by minimizing the cost of dissipating the air when it has served its purpose.

With the use of bicomponent fibers according to this invention, particularly fibers with a CA, EVA, VAL or EVAL polymer in the sheath and polypropylene polymer in the core, tobacco smoke filters can be produced using conventional) commercially available equipment at a significant material cost savings, as high as 70%. Moreover, when very fine melt blown fibers are produced, filters with very high filtration efficiencies up to 80–95%, or more, can result at commercially acceptable pressure drops and at substantially less cost than prior art high filtration filters. Effectively, the filtration efficiency of tobacco smoke filters made according to this invention is at least comparable to prior art filters at a significant cost reduction resulting from the substitution of a lower cost core material for a major part of the fiber. Examples of filters made with various fiber compositions of this invention and related filter performance and cost values are summarized in Tables 1, 2, and 3, discussed hereinafter.

The use of bicomponent fibers in the production of tobacco smoke filters according to this invention in which the sheath comprises VAL or EVAL has the further advantage of improved biodegradability. Except for the conventional filter element, the remaining components of a filtered cigarette disintegrate relatively rapidly under normal environmental conditions, leaving little residue to mar the environment or take up valuable space in waste landfills. However, the highly crimped, bonded cellulose acetate filter elements commonly used in commercially available filtered cigarettes are difficult to destroy, resulting in unsightly and long-lasting, environmentally undesirable litter. VAL and EVAL copolymers readily soften or dissolve in the presence of water. Therefore, the bonded contact points forming tobacco smoke filters according to this invention, wherein the relatively self-sustaining, smoke-pervious filter element is formed by bonding bicomponent sheath-core fibers with a sheath of VAL or EVAL, will break down under normal environmental conditions, leaving behind nothing more than a multiplicity of almost unnoticeable, very fine fibers. Thus, while filter elements formed of such materials can withstand the relatively small quantities of moisture to which they are subjected for a short time during smoking, the bonded contact points will quickly disintegrate along with the remaining portions of the filtered cigarette after use, producing little environmentally undesirable residue. Even using a major proportion of such bicomponent fibers in the production of tobacco smoke filters in combination with other fiber materials, will result in a more readily biodegradable product.

While tobacco smoke filters formed entirely of bicomponent fibers such as described herein are unique and commercially desirable, such bicomponent fibers may be integrated with minor proportions of other polymeric fibers, including cellulose acetate homopolymer fibers, for special applications. However, the maximum cost advantages resulting from this invention are realized by the production of tobacco smoke filters formed entirely of the bicomponent melt blown fibers disclosed herein.

Various properties of such filters may be enhanced by the addition of granular solid or liquid additives. For example, fine activated charcoal particles may be added to a web or roving of such bicomponent fibers before gathering same into a filter rod to provide gas phase filtration characteristics in the resulting filter element as is commonly known by persons familiar with the art. Since conventional cellulose acetate plasticizers tend to "blind" or deactivate activated charcoal, the instant bicomponent fibers provide higher gas phase filtration efficiency due to the absence or reduced amount of plasticizer required. Therefore, a more effective filter can be provided at the same level of charcoal addition, or a lower cost filter will result at the same efficiency.

Likewise, liquid flavor-modifying materials or flavorants may be sprayed onto the fiber to modify or improve the flavor of smoke passing through a filter element made from such materials. For example, menthol is commonly added to tobacco and/or to filter materials in order to produce mentholated cigarettes. However, such materials are commonly absorbed by cellulose acetate fiber, reducing their effectiveness. Since the polypropylene core is non-absorbing and the sheath polymers have little or no absorption; with the instant bicomponent fibers, reduction of the amount of added flavorant necessary to achieve a desired taste effect is possible.

While the instant inventive concepts are useful in the production of bicomponent fibers comprising a CA, EVA, VAL or EVAL polymer sheath and a thermoplastic polymer core that may have utility in any application where fibers formed entirely of cellulose acetate (or, for bondability), have been used heretofore, the principal use that matter, any fiber requiring high strength and presently contemplated for such fibers is in the production of tobacco smoke filters. Likewise, while the tobacco smoke filters of this invention may be associated with cigarettes, cigars, or pipes, the primary commercial application of such filters relates to the use of filters for cigarettes. Therefore, these products will be described herein in detail as exemplary of the broader applications for this invention.

BRIEF DESCRIPTION OF THE DRAWINGS

A better understanding of the present invention, as well as other objects, features and advantages thereof, will become apparent upon consideration of the detailed description herein, in connection with the accompanying drawings wherein.

DETAILED DESCRIPTION OF THE INVENTION

The instant inventive concepts are embodied in a bicomponent, sheath-core, melt blown fiber where the core is a low cost, high strength, thermoplastic polymer, preferably polypropylene, and the sheath is preferably cellulose acetate, ethylene-vinyl acetate copolymer, polyvinyl alcohol, or ethylene-vinyl alcohol copolymer, and tobacco smoke filters made therefrom.

Figure 8:
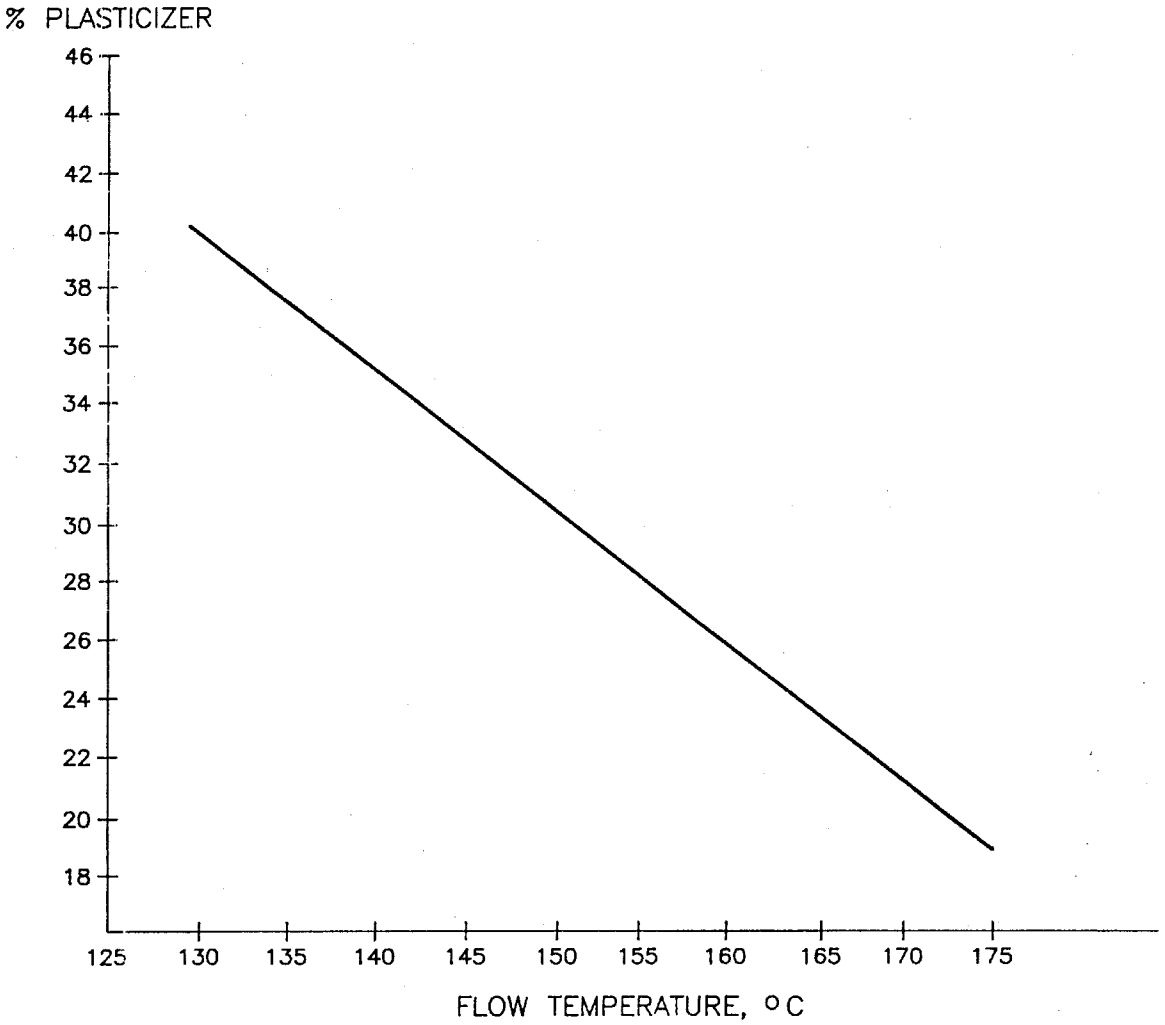
FIG. 8 is a graph showing the effect of plasticizer on flow characteristics of cellulose acetate resins.

The preferred cellulose acetate is cellulose acetate resin in chip form which has been compounded with a standard plasticizer such as triacetin. In order to obtain increasingly smaller melt blown, bicomponent fibers, the cellulose acetate resin must be more highly plasticized to lower its viscosity as is illustrated in FIG. 8. However, the polypropylene core provides structural strength to the fine fibers to assure processability into tobacco smoke filters. Also, with the use of a cellulose acetate resin properly compounded with plasticizer, it is not necessary to further add plasticizer during the manufacture of the bicomponent fiber or in the tobacco filter making process when heat-bonding techniques are applied. Preferably, the cellulose acetate resin will be at about the same acetylation level as the solvent spun cellulose acetate currently used for the commercial production of tobacco smoke filters, although significant variation is possible without major impact on the ultimate product.

When cellulose acetate is used for the sheath material, the preferred plasticizer is an acetic acid ester such as glycerol triacetate ("triacetin") or triethylene glycol diacetate; however, any plasticizer of cellulose acetate may be employed. Because the polypropylene core does not absorb the plasticizer, high quantities of plasticizer are retained on the surface of the bicomponent polymeric fibers which allows the fibers to be bonded solely with the addition of heat during the rod-forming processing. The surface plasticizer also contributes to the favorable taste impact of the fibers on the tobacco smoke. The lack of plasticizer absorption by the polypropylene core also allows the fibers to be stored in the form of fiber tow, web, or roving for a long period of time and subsequently processed into a filter rod using heat-bonding techniques.

Alternate sheath materials to cellulose acetate which have been found to provide good processability and bonding characteristics with acceptable impact on tobacco smoke taste include those polymers containing acetic acid esters and/or an abundance of hydroxyl groups. Polymers in this category include all polymers made by copolymerization of vinyl acetate and one or more other monomers, e.g., ethylene or propylene, preferably ethylene-vinyl acetate copolymers (EVA), as well as the totally or partially hydrolyzed products of the above, preferably polyvinyl alcohol (VAL) usually containing residual acetate groups and ethylene-vinyl alcohol copolymer (EVAL).

Low molecular weight resins are required to produce small diameter bicomponent fibers and in some cases plasticizer may be added to lower viscosity in a relationship similar to that illustrated for plasticized cellulose acetate in FIG. 8. The following examples A and B illustrate the effect of polymer molecular weight on fiber size capability of an EVA/polypropylene bicomponent melt blown fiber and the relationship between the molecular weight of the EVA polymer and its melt viscosity on the resulting fiber size.

| | Example A | Example B |
|---|---|---|
| Sheath Polymer | EVA | EVA |
| Molecular Weight (MW) | 22,450 | 30,600 |
| Melt Flow Rate, g/m (ASTM 1238 –125° C./ 0:325 Kg) | 550 | 115 |
| Melt Viscosity, cps at 250° F. | 325 | 660 |
| Weight, % | 30 | 30 |
| Core Polymer | Polypropylene | Polypropylene |
| Molecular Weight (MW) | 88,400 | 88,400 |
| Melt Flow Rate | 550 | 550 |
| Measured Fiber Size | | |
| Average size in microns | 6.7 | 10.9 |

The melt viscosity can be modified by changing molecular weights through the polymerization process. Also, the blends of copolymers can be adjusted. For example, although the EVA referred to in the examples herein utilized a 20‰ weight % vinylacetate/ethylene blend, this ratio can be varied independently. Further, as mentioned, the use of a plasticizer specific to the sheath polymer at different levels will also modify the melt viscosity. Those skilled in this art can readily select the appropriate parameters to produce a fiber of the desired size and properties within the scope of the instant inventive concepts.

The method of manufacturing the specific polymers used in the production of the bicomponent fibers is not part of the instant invention. Processes for making these polymers are well known in the art and most commercially available CA, EVA, VAL, or EVAL materials can be used. While it is not necessary to utilize sheath and core materials having the same melt viscosity, as each polymer is prepared separately in the bicomponent melt blown fiber process, it may be desirable to select a core material, e.g. polypropylene, of a melt index similar to the melt index of the sheath polymer, or, if necessary, to modify the viscosity of the sheath polymer to be similar to that of the core material to insure compatibility in the melt extrusion process through the bicomponent die. Providing sheath-core components with compatible melt indices is not a significant problem to those skilled in this art with commercially available thermoplastic polymers and additives.

While polypropylene is the preferred core material, other thermoplastic polymeric materials, including polyamides such as nylon 6 and nylon 66, and polyesters such as polyethylene terephthalate, can be used. However, the polyolefins, including both low density and high density polyethylene, are preferred for cost reasons, and polypropylene has been found to be particularly useful in providing the strength needed for production of very fine fibers using melt blown techniques.

While other sheath or core materials may be utilized within the broadest concepts of the instant invention as defined herein and in the appended claims, the preferred sheath is formed either from a plasticized CA, EVA, VAL or EVAL, and the preferred core is formed from polypropylene. Therefore, reference will be made primarily to those materials hereafter.

Figure 1:
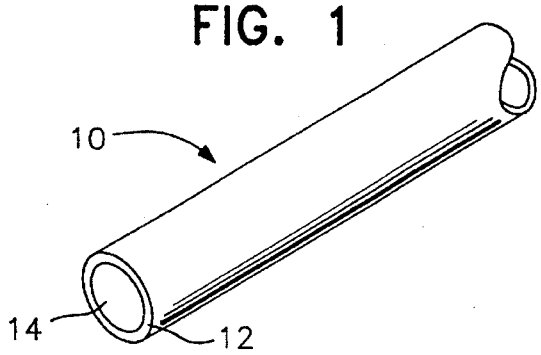
FIG. 1 is an enlarged perspective view of one form of a "sheath-core" bicomponent fiber according to the instant invention.

A bicomponent fiber according to the instant inventive concepts is schematically shown at 10 in FIG. 1. Of course, the size of the fiber and the relative proportion of the sheath-core portions thereof have been greatly exaggerated for illustrative clarity. The fiber 10 is preferably comprised of a CA, EVA, VAL, or EVAL sheath 12 and a polypropylene core 14. The core material comprises at least 50%, and preferably about 80% or more by weight of the overall fiber content.

Figure 2:
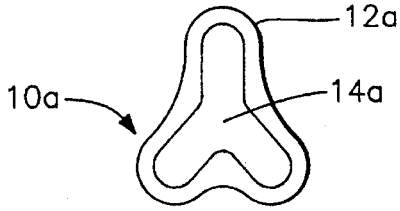
FIG. 2 is an enlarged end elevation view of a trilobal or "Y" shaped bicomponent fiber according to this invention.
Figure 3:
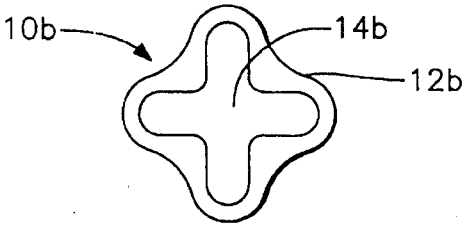
FIG. 3 is a similar view of an "X" or cross-shaped embodiment of the bicomponent fiber of this invention.

The bicomponent fiber shown in FIG. 1 is round in cross section. However, by selecting openings in the sheath-core extrusion die of an appropriate shape, the fiber may be provided with a non-round cross section to increase its surface area for improved filtration of the ultimate tobacco smoke filter, and to enhance the use of air when melt blowing techniques are used for attenuation of the fiber. A trilobal or "Y" shaped fiber 10*a* is shown in FIG. 2 comprising a sheath 12*a* and a core 14*a*. Similarly, a cross or "X" shaped bicomponent fiber as seen at 10*b* in FIG. 3, comprising a sheath 12*b* and a core 14*b*, is illustrative of many multi-legged fiber core sections possible. It will be seen that, in each instance, the sheath completely covers the core material. Failure to enclose any major portion of the core material minimizes or obviates many of the advantages of the instant invention discussed herein.

Figure 4:
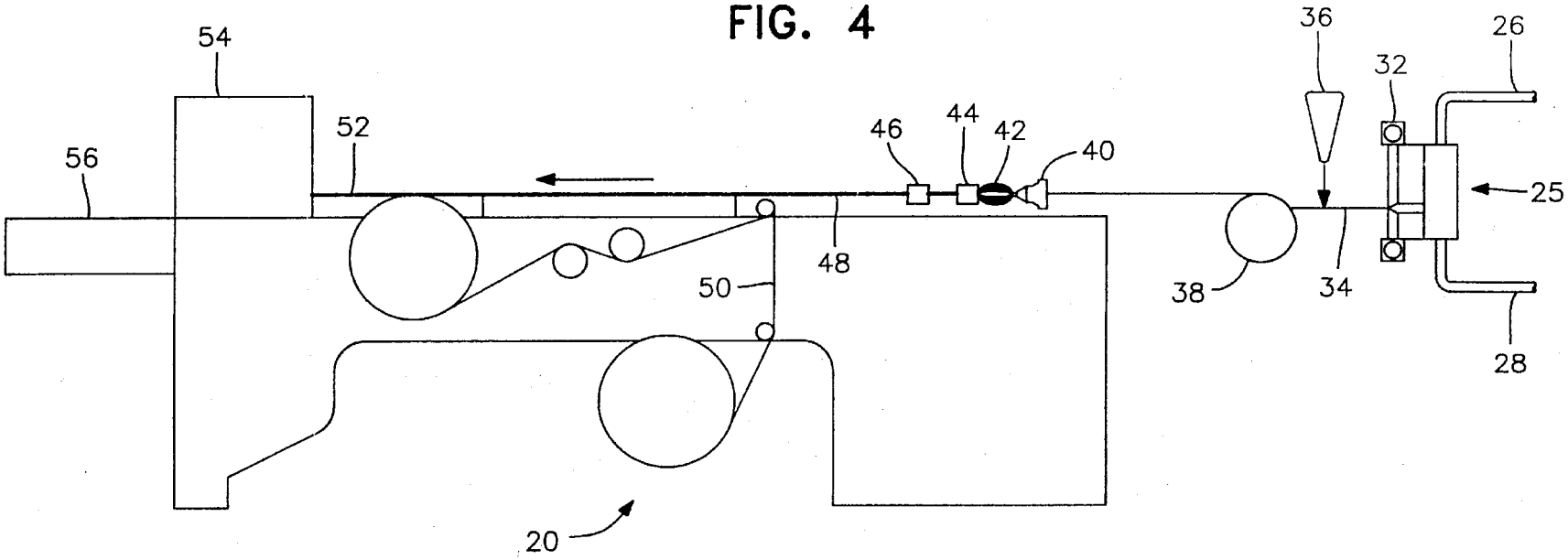
FIG. 4 is a schematic view of one form of a process line for producing tobacco smoke filter rods from the bicomponent fibers of this invention.
Figure 5:
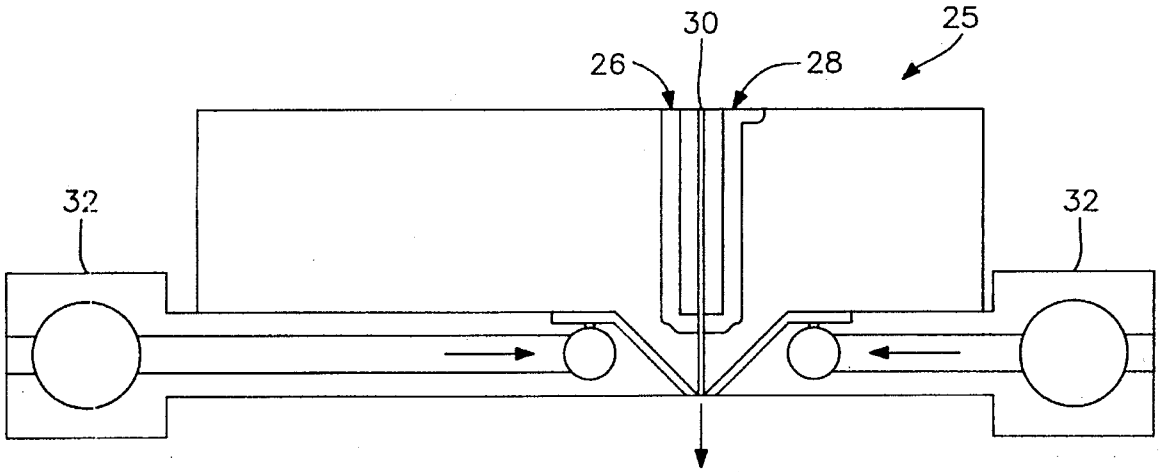
FIG. 5 is an enlarged schematic view of the sheath-core melt blown die portion of the processing line of FIG. 4.

FIGS. 4 and 5 schematically illustrate preferred equipment used in making a bicomponent fiber according to the instant inventive concepts, and processing the same into filter rods that can be subsequently subdivided to form filter elements used in the production of filtered cigarettes or the like. The overall processing line is designated generally by the reference numeral 20 in FIG. 4. In the embodiment shown, the bicomponent fibers themselves are made in-line with the equipment utilized to process the fibers into tobacco smoke filter rods. Such an arrangement is practical with the melt blown techniques of this invention because of the small footprint of the equipment required for this procedure. While the in-line processing is unique and has obvious commercial advantages, it is to be understood that, in their broadest sense, the instant inventive concepts are not so limited, and bicomponent fibers according to this invention may be separately made and stored for extended periods of time.

Whether in-line or separate, the bicomponent fibers themselves can be made using standard fiber spinning techniques for forming bicomponent filaments as seen, for example, in Powell U.S. Pat. Nos. 3,176,345 or 3,192,562 or Hills U.S. Pat. No. 4,406,850. The subject matter of each of the foregoing patents is incorporated herein in its entirety by reference for exemplary information regarding common techniques for the production of bicomponent fibers including sheath-core fibers. Likewise, methods and apparatus for melt blowing of fibrous materials, whether they are bicomponent or not, are well known. For example, reference is made to Buntin U.S. Pat. Nos. 3,615,995 and 3,595,245, Schwarz U.S. Pat. Nos. 4,380,570 and 4,731,215, and Lohkamp et al, U.S. Pat. No. 3,825,379, the entire subject matter of each of which is incorporated herein by reference for further background in this technology. The foregoing references are to be considered to be illustrative of well known techniques and apparatus for forming of bicomponent fibers and melt blowing for attenuation that may be used according to the instant inventive concepts, and are not to be interpreted as limiting thereon.

In any event, one form of a sheath-core melt blown die is shown enlarged in FIG. 5 at 25. Molten sheath-forming polymer 26, and molten core-forming polymer 28 are fed into the die 25 and extruded therefrom through a pack of polymer distribution plates shown schematically at 30 which may be of the type shown in the aforementioned Hills U.S. Pat. No. 4,406,850.

As previously discussed, bicomponent fibers need not be melt blown in accordance with the broadest concept of this invention. Alternatively, the fibers could be collected in web form using techniques commonly referred to as "spun bonded" or "spun laced" (not shown). However, using melt blown techniques which extrude the molten fibers into a high velocity air stream such as provided through an air plate shown schematically at 32, attenuates and solidifies the fibers, enabling the production of ultrafine bicomponent fibers on the order of 10 microns or less. Such treatment produces a randomly dispersed entangled web or roving 34 (see FIG. 4) of the bicomponent fibers which is a form suitable for immediate processing without subsequent attenuation or crimp-inducing processing.

A layer of a particulate additive such as granular activated charcoal may be deposited on the tow 34 as shown schematically at 36. Alternatively, a liquid additive such as a flavorant or the like may be sprayed onto the tow 34 (not shown). A screen covered vacuum collection drum as shown schematically at 38 or similar device is used to separate the fibrous web or roving 34 from entrained air to facilitate further processing.

The remainder of the processing line seen in FIG. 4 is conventional, as shown and described in further detail in patents issued to the inventor hereof, Richard M. Berger, although modifications may be required to individual elements thereof in order to facilitate heat-bonding of the fibers. Exemplary Berger patents include U.S. Pat. Nos. 4,869,275, 4,355,995, and 3,637,447, the subject matter of each of which is incorporated herein in its entirety by reference. Such heat-bonding techniques are illustrated in FIG. 4 where a web or roving 34 of bicomponent fibers are produced using melt blowing techniques and continually passed through a conventional air jet at 40, bloomed as seen at 42 and gathered into a rod shape in a heated air or steam die 44 where the sheath of plasticized cellulose acetate or other suitable sheath polymer is activated to render the same bondable. Other heating techniques, such as dielectric heating, may be useful or desirable with selected sheath materials. In any event, the resultant material is cooled by air or the like in the die 46 to produce a relatively stable and self-sustaining rod-like fiber structure 48. The fiber rod 48 can be wrapped with paper or the like 50 (plugwrap) in a conventional manner to produce a continuously wrapped fiber rod 52. The continuously produced fiber rod 52, whether wrapped or not, may be passed through a standard cutter head 54 at which point it is cut into preselected tobacco filter rod lengths and deposited into an automatic packaging machine.

Figure 6:
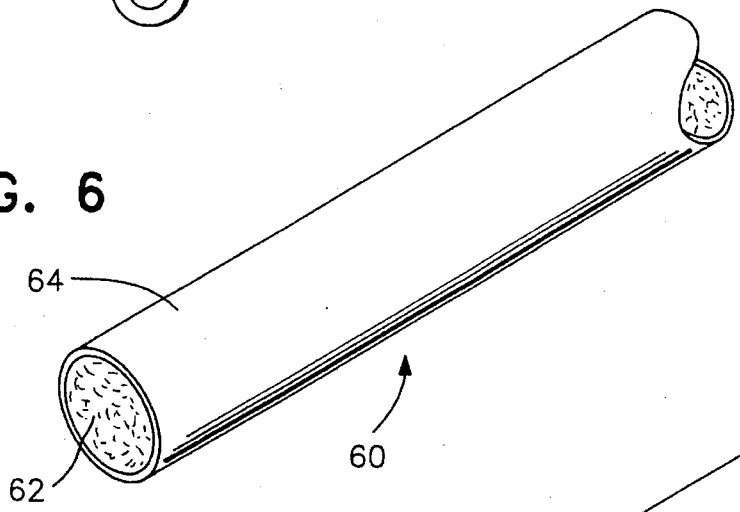
FIG. 6 is an enlarged perspective view of a tobacco smoke filter rod produced from bicomponent fibers according to the instant invention concepts.

By subdividing the resultant filter rods in any well known manner, a multiplicity of discrete tobacco filter elements or plugs according to this invention are formed, one of which is illustrated schematically in FIG. 6 at 60. Each filter element 60 comprises an elongated air-permeable body of tobacco smoke filter material 62 encased in plugwrap 64. The filter material 62, according to this invention is comprised of a multiplicity of bicomponent fibers such as shown in 10 in FIG. 1, bonded at their contact points to define a tortuous interstitial path for passage of tobacco smoke in use.

It is to be understood that the filter rods produced in accordance with this invention need not be of uniform construction throughout as illustrated herein, but could have interior pockets, exterior grooves, crimped portions or other modifications as shown in the aforementioned prior patents to Berger, or others, without departing from the instant inventive concepts.

Figure 7:
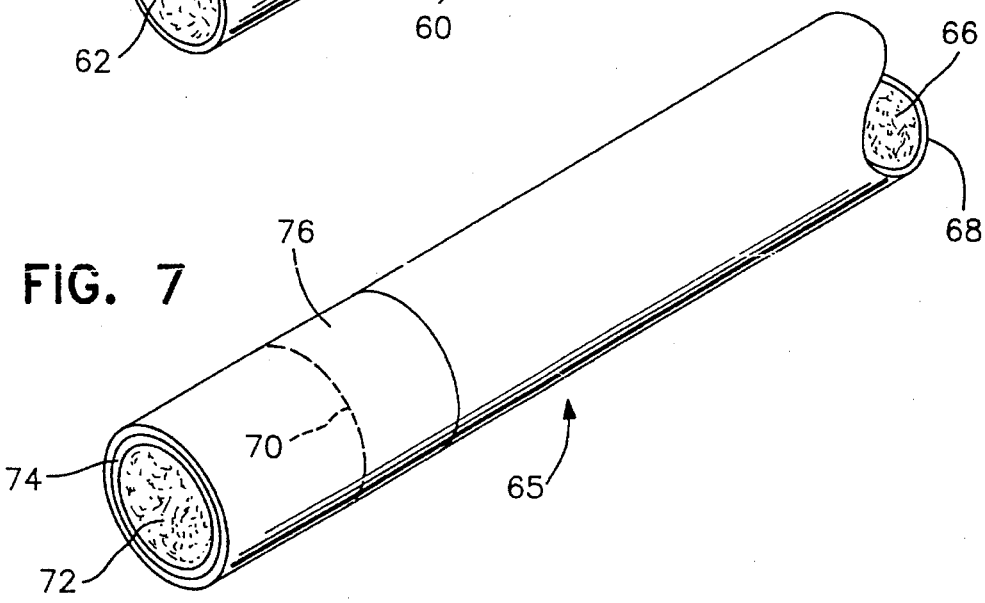
FIG. 7 is an enlarged perspective view of a cigarette including a filter element according to this invention.

Portions of a conventional filtered cigarette are illustrated schematically at 65 in FIG. 7 as comprising a tobacco rod 66 covered by a conventional cigarette paper 68 and secured to a filter means comprising a discrete filter element 70, such as would result from further subdividing a filter rod on conventional cigarette manufacturing equipment (not shown). The filter element 70 comprises a body of filtering material 72 over-wrapped by plugwrap 74 and secured to the tobacco rod in a conventional manner as by standard tipping wrap 76.

The examples set forth in Tables 1, 2, and 3 provide further information regarding the instant inventive concepts. It is to be understood, however, that these examples are illustrative and the various materials and processing parameters may be varied within the skill of the art without departing from the instant inventive concepts.

TABLE 1

| Example No. | 1 | 2 | 3 | 4 | 5 | 6 |
|---|---|---|---|---|---|---|
| Sheath Polymer | Control* | EVA | Control* | EVA | VAL | CA |
| Core Polymer | Same | PP | Same | PP | PP | PP |
| Sheath/Core Ratio | N/A | 30/70 | N/A | 30/70 | 40/60 | 30/70 |
| Filter Weight, g** | 0.150 | 0.132 | 0.171 | 0.136 | 0.167 | 0.210 |
| Pressure Drop, inches water | 2.8 | 2.7 | 4.5 | 4.5 | 4.4 | 3.8 |
| Total Particulate Matter Retention, % | 57 | 63 | 69 | 74 | 76 | 67 |

*Conventional Cellulose Acetate (CA) Fiber
**27 mm Filter
EVA: Ethylene-vinyl acetate copolymer
VAL: Polyvinyl alcohol
PP: Polypropylene

TABLE 2

| Example No. | 7 | 8 | 9 | 10 |
|---|---|---|---|---|
| Sheath Polymer | Control* | EVA | EVA | VAL |
| Core Polymer | Same | PP | PP | PP |
| Sheath/Core Ratio | N/A | 30/70 | 30/70 | 40/60 |
| Activated Charcoal, g** | 0.066 | 0.050 | 0.050 | 0.033 |
| Fiber Weight, g** | 0.127 | 0.095 | 0.095 | 0.145 |
| Pressure Drop, inches water | 4.2 | 4.2 | 3.4 | 3.4 |
| Total Particulate Matter Retention, % | 63 | 76 | 71 | 73 |
| Vapor Phase Retention, % | 52 | 77 | 78 | 50 |

*Conventional Cellulose Acetate Fiber
**20 mm Filter
EVA: Ethylene-vinyl acetate copolymer
VAL: Polyvinyl alcohol
PP: Polypropylene

TABLE 3

| Selective Comparison of Raw Material Costs | | | | | |
|---|---|---|---|---|---|
| Example | | Price | Fiber Weight | | Cost |
| No. | Material | $/lb | % | g/120 mm | $/1000 |
| 1 (Control) | Cellulose Acetate Fiber | 1.63 | 100 | 0.667 | 2.39 |
| 2 | PP | 0.46 | 70 | 0.412 | 0.42 |
| | EVA | 0.74 | 30 | 0.176 | 0.29 |
| | Total | | 100 | 0.588 | 0.71 |
| 3 (Control) | Cellulose | 1.63 | 100 | 0.762 | 2.74 |

TABLE 3-continued

| Selective Comparison of Raw Material Costs | | | | | |
|---|---|---|---|---|---|
| Example | | Price | Fiber Weight | | Cost |
| No. | Material | $/lb | % | g/120 mm | $/1000 |
| | Acetate Fiber | | | | |
| 4 | PP | 0.46 | 70 | 0.423 | 0.43 |
| | EVA | 0.74 | 30 | 0.182 | 0.30 |
| | Total | | 100 | 0.605 | 0.73 |
| 5 | PP | 0.46 | 60 | 0.447 | 0.453 |
| | VAL | 1.75 | 40 | 0.298 | 1.149 |
| | Total | | 100 | 0.745 | 1.602 |
| 6 | PP | 0.46 | 70 | 0.63 | 0.638 |
| | CA Resin | 1.86 | 30 | 0.27 | 1.106 |
| | Total | | 100 | 0.90 | 1.744 |
| 7 (Control) | Cellulose Acetate Fiber | 1.63 | 65.5 | 0.76 | 2.729 |
| | Activated Charcoal | 1.74 | 34.5 | 0.40 | 1.533 |
| | Total | | 100 | 1.16 | 4.262 |
| 8/9 | PP | 0.46 | 46.0 | 0.40 | 0.405 |
| | EVA | 0.74 | 19.5 | 0.17 | 0.277 |
| | Activated Charcoal | 1.74 | 34.5 | 0.30 | 1.150 |
| | Total | | 100 | 0.87 | 1.832 |
| 10 | PP | 0.46 | 48.6 | 0.52 | 0.527 |
| | VAL | 1.75 | 32.7 | 0.35 | 1.349 |
| | Activated Charcoal | 1.74 | 18.7 | 0.20 | 0.767 |
| | Total | | 100 | 1.07 | 2.643 |

By comparison of the controls in Table 1 with filter elements formed according to this invention, it will be seen that improved filtration is possible with commercially acceptable pressure drops and reduced filter weight. More importantly, as seen from Table 3, the raw material costs are reduced dramatically, by as much as 70%. Similarly, in Table 2, when activated charcoal is added to the filter element, both solid and vapor phase filtration are improved, notwithstanding the significantly reduced raw material costs evidenced in Table 3. Cost and functional advantages comparable to those shown with VAL are expected with a sheath of EVAL.

While preferred embodiments and processing parameters have been shown and described, it is to be understood that these examples are illustrative and can be varied within the skill of the art without departing from the instant inventive concepts.

What is claimed is:

1. A tobacco smoke filter means comprising a substantially self-sustaining substantially cylindrical element of fibrous material comprising continuous fibers bonded to each other at spaced points of contact to define a tortuous interstitial path for passage of smoke therethrough, at least a major part of said fibers being bicomponent fibers comprising a core of a thermoplastic material substantially totally surrounded by a sheath of a polymer selected from the group consisting of cellulose acetate, ethylene-vinyl acetate copolymer, polyvinyl alcohol and ethylene-vinyl alcohol copolymer, wherein said fibrous web comprises an entangled web or roving of said bicomponent fibers having an average diameter of about 10 microns or less.

2. The filter means of claim 1, wherein said sheath material is ethylene-vinyl acetate copolymer.

3. The filter means of claim 2, wherein said core material is polypropylene.

4. The filter means of claim 1, wherein said sheath material is selected from the group consisting of polyvinyl alcohol and ethylene-vinyl alcohol copolymer.

5. The filter means of claim 4, wherein said sheath material is ethylene-vinyl alcohol copolymer.

6. The filter means of claim 5, wherein said core material is polypropylene.

7. The filter means according to claim 1, further including an additive carried by the fibers of said filter element.

8. The filter means of claim 7, wherein said additive is activated charcoal.

9. The filter means of claim 7, wherein said additive is a flavorant.

10. A filter rod comprising a multiplicity of filter elements according to claim 1 integrally connected to each other in end-to-end relationship.

11. A cigarette comprising a tobacco portion and a filter portion, wherein said filter portion comprises a filter means according to claim 1.

12. A cigarette according to claim 11, wherein said sheath material is ethylene-vinyl acetate copolymer.

13. A cigarette according to claim 12, wherein said core material is polypropylene.

14. A cigarette according to claim 11, wherein said sheath material is ethylene-vinyl alcohol copolymer.

15. A cigarette according to claim 14, wherein said core material is polypropylene.

16. The filter means of claim 1, wherein said core material comprises at least about 50% by weight of said bicomponent fibers.

17. The filter means of claim 1, wherein said core material comprises from about 50% to 90% by weight of said bicomponent fibers.

18. The filter means of claim 17, wherein said core material comprises at least about 80% by weight of said bicomponent fibers.

19. The filter means of claim 17, wherein said fibers are substantially all bicomponent fibers.

20. A tobacco smoke filter means comprising a substantially self-sustaining substantially cylindrical element of fibrous material comprising continuous fibers bonded to each other at spaced points of contact to define a tortuous interstitial path for passage of smoke therethrough, at least a major part of said fibers being bicomponent fibers comprising a core of a thermoplastic material substantially totally surrounded by a sheath of plasticized cellulose acetate.

21. The filter means of claim 20, wherein said core material is polypropylene.

22. A tobacco smoke filter means comprising a substantially self-sustaining substantially cylindrical element of fibrous material comprising continuous fibers bonded to each other at spaced points of contact to define a tortuous interstitial path for passage of smoke therethrough, at least a major part of said fibers being bicomponent fibers comprising a core of a thermoplastic material substantially totally surrounded by a sheath of polyvinyl alcohol.

23. The filter means of claim 22, wherein said core material is polypropylene.

24. A cigarette comprising a tobacco portion and a filter portion, wherein said filter portion includes a filter means comprising a substantially self-sustaining element of fibrous material comprising continuous fibers bonded to each other at spaced points of contact to define a tortuous interstitial path for passage of smoke therethrough, at least a major part of said fibers being bicomponent fibers comprising a core of a thermoplastic material substantially totally surrounded by a sheath of plasticized cellulose acetate.

25. A cigarette according to claim 24, wherein said core material is polypropylene.

26. A cigarette comprising a tobacco portion and a filter portion, wherein said filter portion includes a filter means comprising a substantially self-sustaining element of fibrous material comprising continuous fibers bonded to each other at spaced points of contact to define a tortuous interstitial path for passage of smoke therethrough, at least a major part of said fibers being bicomponent fibers comprising a core of thermoplastic material substantially totally surrounded by a sheath of polyvinyl alcohol.

27. A cigarette according to claim 26, wherein said core material is polypropylene.

28. A method of making tobacco smoke filter means comprising:

a) providing separate sources of a molten core-forming thermoplastic material and a molten sheath-forming material selected from the group consisting of cellulose acetate, copolymers of vinyl acetate and at least one other monomer, and totally and partially hydrolyzed products of said copolymers;

b ) continuously extruding said molten core-forming and sheath-forming materials through a multiplicity of openings in a conjugate sheath-core die to provide a highly entangled web of bicomponent fibers, each fiber comprising a continuous core of core-forming material substantially totally surrounded by a sheath of sheath-forming material;

c) contacting said bicomponent fibers with a gas under pressure as they exit the sheath-core die sufficiently to attenuate said bicomponent fibers while they are still in their molten state to produce a web or roving of randomly dispersed entangled bicomponent fibers having an average diameter of about 10 microns or less;

d) gathering said web of bicomponent fibers into a continuous rod-like shape;

e) continuously heating said gathered web to render the same bondable at the points of contact of the fibers;

f) cooling the resultant element to form a continuous rod defining a tortuous path for passage of smoke; and g) cutting the same into discrete lengths.

29. The method of claim 28, wherein said core-forming material is a polyolefin.

30. The method of claim 29, wherein said polyolefin is polypropylene.

31. The method of claim 28, wherein said sheath-forming material is selected from the group consisting of cellulose acetate, ethylene-vinyl acetate copolymer, polyvinyl alcohol and ethylene-vinyl alcohol copolymer.

32. The method of claim 28, wherein said sheath-forming material is ethylene-vinyl alcohol copolymer.

33. The method of claim 32, wherein said core-forming material is polypropylene.

34. The method of claim 28, wherein said openings of said sheath-core die through which said bicomponent fibers are extruded are non-circular, thereby producing bicomponent fibers of a non-round cross-section.

35. The method of claim 34, wherein said fibers have a "Y" shaped cross-section.

36. The method of claim 34, wherein said fibers have an "X" shaped cross-section.

37. The method of claim 28, further including incorporating an additive into said web or roving as said bicomponent fibers exit the sheath-core die.

38. The method of claim 37 wherein said additive is activated charcoal.

39. The method of claim 28, wherein said bicomponent fibers are formed and processed into said rod in a continuous, in-line, manner.

40. A method of making tobacco smoke filter means comprising:

a) providing separate sources of a molten core-forming thermoplastic material and molten sheath-forming material comprising plasticized cellulose acetate;

b) continuously extruding said molten core-forming and sheath-forming materials through a multiplicity of openings in a conjugate sheath-core die to provide a highly entangled web of bicomponent fibers, each fiber comprising a continuous core of core-forming material substantially totally surrounded by a sheath of sheath-forming material;

c) gathering said web of bicomponent fibers into a rod-like shape;

d) heating said gathered web to render the same bondable at the points of contact of the fibers;

e) cooling the resultant element to form a continuous rod defining a tortuous path for passage of smoke; and f) cutting the same into discrete lengths.

41. The method of claim 40, wherein said core-forming material is polypropylene.

42. A method of making tobacco smoke filter means comprising:

a) providing separate sources of a molten core-forming thermoplastic material and a molten sheath-forming material comprising ethylene-vinyl acetate copolymer;

b) continuously extruding said molten core-forming and sheath-forming materials through a multiplicity of openings in a conjugate sheath-core die to provide a highly entangled web of bicomponent fibers, each fiber comprising a continuous core of core-forming material substantially totally surrounded by a sheath of sheath-forming material;

c) gathering said web of bicomponent fibers into a rod-like shape;

d) heating said gathered web to render the same bondable at the points of contact of the fibers;

e) cooling the resultant element to form a continuous rod defining a tortuous path for passage of smoke; and f) cutting the same into discrete lengths.

43. The method of claim 42, wherein said core-forming material is polypropylene.

44. A method of making tobacco smoke filter means comprising:

a) providing separate sources of a molten core-forming thermoplastic material and molten sheath-forming material comprising polyvinyl alcohol;

b) continuously extruding said molten core-forming and sheath-forming materials through a multiplicity of openings in a conjugate sheath-core die to provide a highly entangled web of bicomponent fibers, each fiber comprising a continuous core of core-forming material substantially totally surrounded by a sheath of sheath-forming material;

c) gathering said web of bicomponent fibers into a rod-like shape;

d) heating said gathered web to render the same bondable at the points of contact of the fibers;

e) cooling the resultant element to form a continuous rod defining a tortuous path for passage of smoke; and f) cutting the same into discrete lengths.

45. The method of claim 44, wherein said core-forming material is polypropylene.

* * * * *

UNITED STATES PATENT AND TRADEMARK OFFICE

CERTIFICATE OF CORRECTION

PATENT NO. : 5,509,430

DATED : April 23, 1996

INVENTOR(S) : Richard M. Berger

It is certified that error appears in the above-identified patent and that said Letters Patent is hereby corrected as shown below:

On title page, item [56] second column, after line 3 ("5,298,348 3/1994 Kung") insert:

| | | | |
|---|---|---|---|
| – | 4,173,504 | 11/1979 | Tomioka et al. |
| | 3,192,562 | 7/1965 | Powell |
| | 2,936,482 | 5/1960 | Kilian |
| | 4,795,668 | 1/1989 | Krueger et al. |
| | 3,825,380 | 7/1974 | Harding et al. |
| | 4,406,850 | 9/1983 | Hills |
| | 4,270,962 | 6/1981 | Sugihara et al. |
| | 3,176,345 | 4/1965 | Powell |
| | 4,217,321 | 8/1980 | Campbell |
| | 3,595,245 | 7/1971 | Buntin et al. |
| | 3,849,241 | 11/1974 | Butin et al. |
| | 4,869,275 | 9/1989 | Berger |
| | 4,355,995 | 10/1982 | Berger |
| | 4,380,570 | 4/1983 | Schwarz |
| | 4,731,215 | 3/1988 | Schwarz |
| | 3,615,995 | 10/1971 | Buntin et al. |
| | 5,162,153 | 11/1992 | Cooke et al. |
| | 3,825,379 | 7/1974 | Lohkamp et al. |
| | 4,117,194 | 9/1978 | Barbe et al. |
| | 3,637,447 | 1/1972 | Berger et al. |

FOREIGN PATENT DOCUMENTS

| | | |
|---|---|---|
| 1 601 585 | 11/1981 | United Kingdom |
| 2 152 944 | 8/1985 | United Kingdom |
| 2 036 115 | 6/1980 | United Kingdom |

UNITED STATES PATENT AND TRADEMARK OFFICE

CERTIFICATE OF CORRECTION

PATENT NO. : 5,509,430

DATED : April 23, 1996

INVENTOR(S) : Richard M. Berger

It is certified that error appears in the above-indentified patent and that said Letters Patent is hereby corrected as shown below:

OTHER PUBLICATIONS

Fundamentals of Fibre Formation, Andrez Ziabicki, John Wiley & Sons, pp. 366.373, 386. --.

Signed and Sealed this

Fourteenth Day of July, 1998

Bruce Lehman

*Attest:*

BRUCE LEHMAN

*Attesting Officer*

*Commissioner of Patents and Trademarks*